United States Patent [19]

Penisson

[11] Patent Number: 5,042,601

[45] Date of Patent: Aug. 27, 1991

[54] TRIPLE TOOL WITH SLIDING SPIDER BOWL

[75] Inventor: Dennis Penisson, Raceland, La.

[73] Assignee: Bilco Tools, Inc., Houma, La.

[21] Appl. No.: 555,617

[22] Filed: Jul. 23, 1990

[51] Int. Cl.[5] ..... E21B 19/10

[52] U.S. Cl. ..... 175/423; 166/85; 166/96; 166/97.5; 188/67

[58] Field of Search ..... 175/423; 166/75.1, 77.5, 166/53, 85, 96, 97.5, 313; 188/67; 294/102.2

[56] References Cited

U.S. PATENT DOCUMENTS

| | | | |
|---|---|---|---|
| 2,351,887 | 6/1944 | Steadman | 175/423 |
| 3,071,396 | 1/1963 | Neilon | 285/137 |
| 3,080,181 | 3/1963 | Watts et al. | 285/137 |
| 3,571,865 | 3/1971 | Johnson | 188/67 |
| 4,275,487 | 6/1981 | Gray et al. | 188/67 |
| 4,297,771 | 11/1981 | Anderson et ai. | 294/102.2 |
| 4,354,706 | 10/1982 | Coyle, Sr. | 175/423 |
| 4,381,584 | 5/1983 | Coyle, Sr. | 24/263 D |
| 4,715,456 | 12/1987 | Poe, Jr. et al. | 175/423 |

FOREIGN PATENT DOCUMENTS

| | | | |
|---|---|---|---|
| 2905214 | 8/1979 | Fed. Rep. of Germany | 175/423 |

*Primary Examiner*—Bruce M. Kisliuk

*Attorney, Agent, or Firm*—Browning, Bushman, Anderson & Brookhart

[57] ABSTRACT

An slip bowl assembly for supporting multiple pipes in a well casing includes at least two bowls which can be moved away from the centerline of the well by remote control, to allow large collars or tools on the pipe to pass through the assembly.

20 Claims, 5 Drawing Sheets

TRIPLE TOOL WITH SLIDING SPIDER BOWL

BACKGROUND

1. Field of the Invention

This invention relates to oil well service equipment, particularly to a device for moving pipe into or out of a well. The invention is particularly designed to allow one to raise or lower pipes having large collars or tools through a multiple-bowl support.

2. Description of the Prior Art

Pipes used in oil wells, either during drilling or during production of the well, are generally made up from sections of pipe about thirty feet long. A string of such sections is formed by lowering the string by means of an elevator to near the drilling rig deck surface, then securing the string with slips in a structure at the deck surface (to keep the pipe from falling into the well). At this point, a new section of pipe is threaded to the upper end of the existing string, the elevator is raised and engaged with the upper end of the new section, the slips in the supporting structure are released, and the elevator lowered. This cycle is repeated until a string of desired length—often thousands of feet—is formed. A large variety of supports for carrying out this operation are known.

It is often desired to provide a well with more than one pipe string. For this purpose, there are multiple-pipe supports and elevators. Particularly with such devices, the insertion of large-diameter tools and collars into the well is problematic, because the multiple pipe supports tend to obstruct the well opening. Although the pipes can be temporarily supported well above the deck surface by the elevator, it would be desirable to expose an opening in the supporting device equal to the diameter of the well casing, so that large tools and the like could be inserted. This problem has been recognized: for example, U.S. Pat. No. 3,071,396 provides a device with an enlarged central portion, which permits passage of larger couplings.

None of the prior devices is wholly satisfactory, for various reasons. The need remains for a multiple-pipe support device that can be readily and remotely "opened" to permit large elements to enter or leave the well.

SUMMARY OF THE INVENTION

In view of the foregoing, it is an object of the invention to enable one to support a plurality of pipes within a well casing at once, and yet not so obstruct the casing that large diameter tools cannot pass the supporting device.

Another object of the invention is to provide a multiple pipe support which can be removed from around the pipes, without removing the pipes from the well.

A further object of the invention is to prevent damage to the pipes from inadvertently retracting bowls supporting the pipe while slips within the bowls are engaged with the pipes.

These and other objects of the invention are met by an multiple bowl assembly comprising a plate, adapted to rest on a drilling rig deck, the plate having an opening for vertical passage therethrough of plural pipes, and a plurality of slip bowls supported by the base plate, wherein each of the slip bowls is laterally movable, between a deployed position over the opening, and a retracted position away from the opening, so that large drilling tools and the like can pass into and out of the well.

BRIEF DESCRIPTION OF THE DRAWINGS

In the accompanying drawings.

DESCRIPTION OF THE PREFERRED EMBODIMENT

Figure 2:
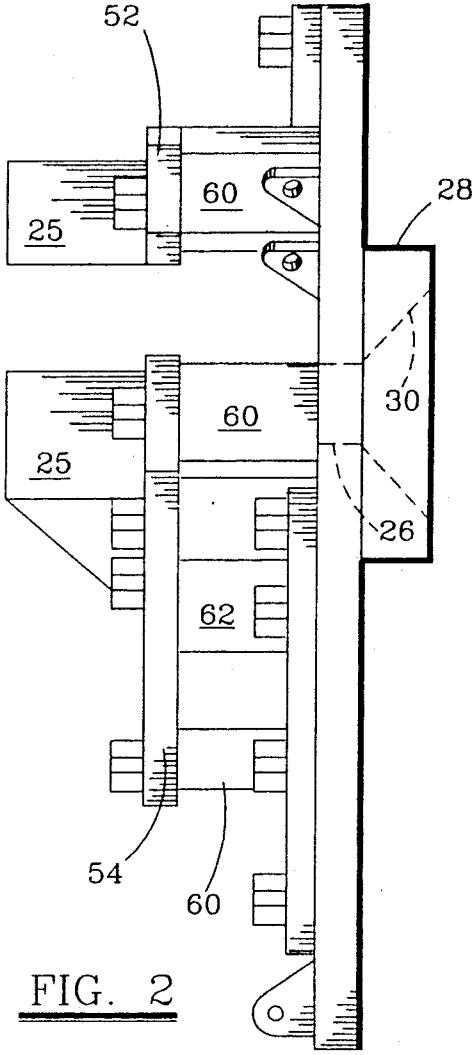
FIG. 2 is a side elevation thereof, with other parts removed.
Figure 1:
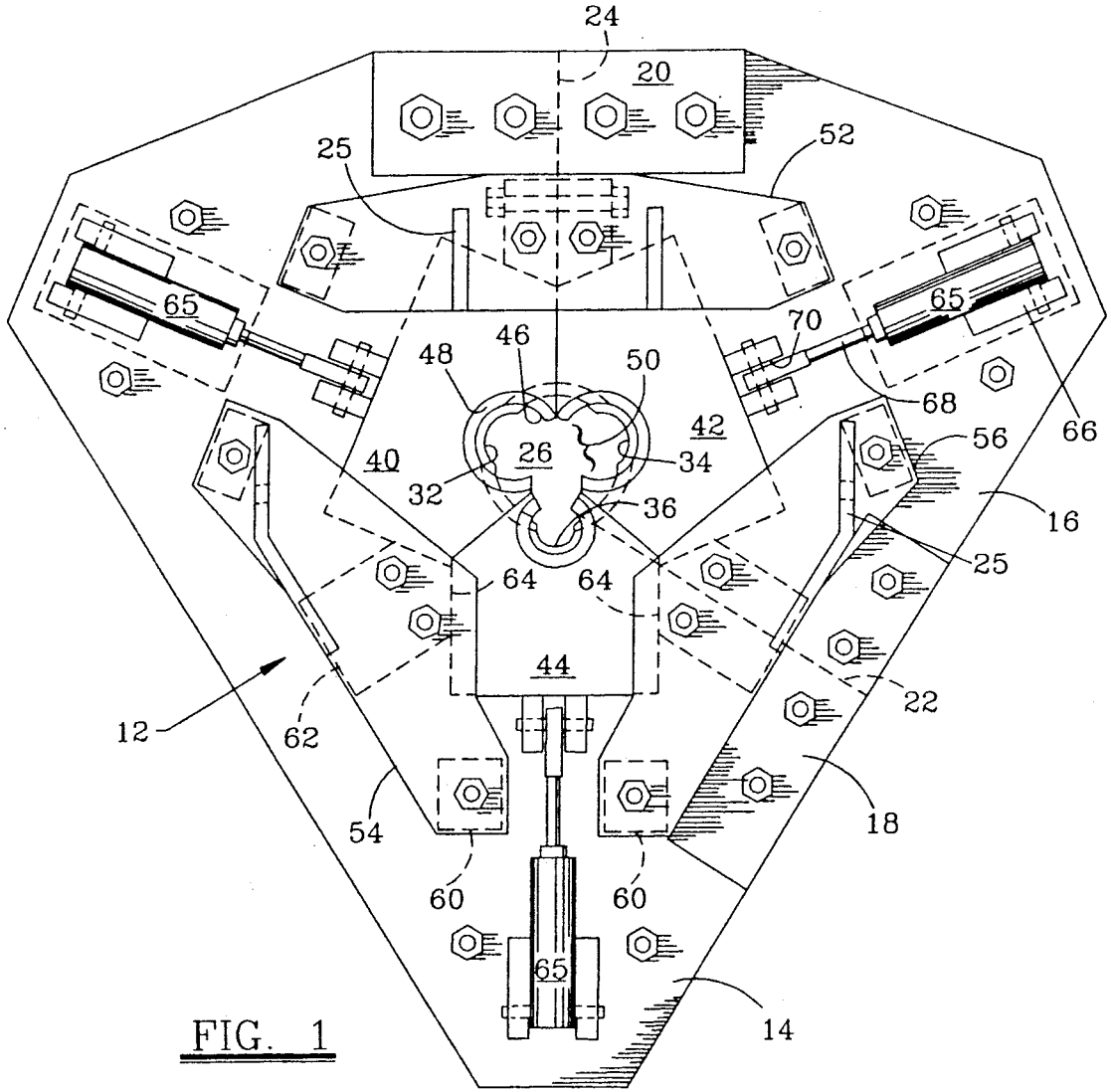
FIG. 1 is a top plan view of a slip bowl assembly embodying the invention, with parts removed, for clarity.
Figure 8:
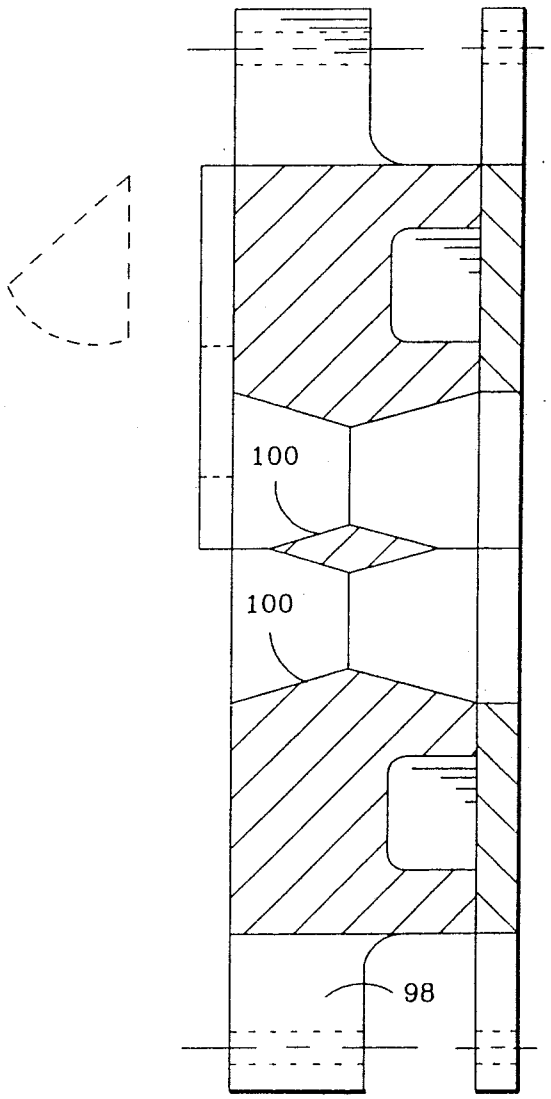
FIG. 8 is a sectional view thereof, taken along the line 8—8 in FIG. 7.
Figure 7:
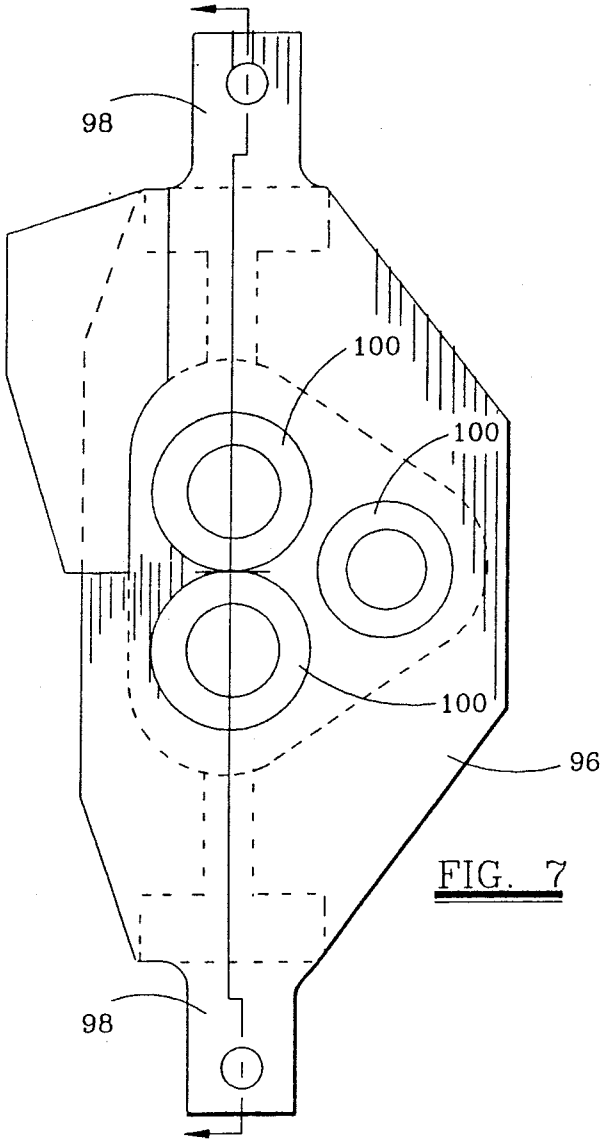
FIG. 7 is a top view of an elevator for use with the invention, with parts removed.

A slip bowl assembly embodying the invention is illustrated in FIGS. 1 and 2. The assembly includes a massive base plate 12, intended to be supported by a stationary drilling deck, for supporting the weight of one or more pipe strings suspended in a well casing while an elevator is disengaged from the pipe. The elevator, partially shown in FIGS. 7 and 8, is associated with hoisting cables, not shown, suspended from a superstructure above the deck. When raising or lowering pipe, the load is alternately shifted between the elevator and the slip bowl assembly; whenever the elevator is disengaged, the slip bowl assembly supports the entire weight of the pipe strings.

As shown in FIG. 1, the base plate is preferably made in two sections 14,16 normally interconnected by connecting straps 18,20 spanning the joints 22,24, so that, if it is necessary to remove the slip bowl assembly during operations, the slip bowl assembly can be separated and removed without having to pull the pipe from the well. (Alternatively, the base plate could be manufactured in a single piece, with a large lateral slot, to permit removal.) The tabs 25 shown protect the slips described below from being damaged by the elevator.

The base plate has a central opening 26, extending through a collar 28 (FIG. 2) on the bottom of the plate; this collar fits in a corresponding opening in the drilling rig deck (not shown). The bottom of the opening 26 is flared at 30 to facilitate withdrawal of objects from the well. As shown in FIG. 1, the opening preferably has cutouts or recesses 32,34,36 to allow pipe to be positioned as far as possible from the centerline of the well, and to enable the slip bowls 40,42,44 better to support the pipes. In the preferred embodiment illustrated, each of the three slip bowls has a vertical through bore 46 having a conical, tapered wall 48. The bore has a lateral opening 50 at least as wide as the pipe for which the bowl is intended, so that the bowl can be withdrawn from the pipe when needed, to provide maximum clearance for large tools passing through the opening.

Each of the slip bowls has a planar lower surface that rests on the upper surface of the base plate. The bowls are prevented from moving vertically by respective retainer plates 52, 54,56, which are supported above the bowls by end standoffs 60 and intermediate standoffs 62 positioned between the base plate and the retainer plates. The end standoffs 60 lie behind the bowls, and thus limit their outward motion. The intermediate standoffs on either side of a given bowl have parallel sides 64, and provide means for guiding the bowl along a horizontal, linear path whose direction is radial to (i.e., toward the center of) the opening.

The bowls are moved along their paths by respective motors, which are preferably automatically controlled by a system described below. The term "motors" is intended to be generic to any motion-producing device; a hydraulic cylinder is one type of linear motor. To move the bowls, we presently prefer to use double-acting hydraulic cylinders, for fire safety reasons, in preference to electrical devices. As shown in FIG. 1, each bowl is associated with a respective hydraulic cylinder 65, one of which is shwon in detail in FIG. 6. As illustrated, the body of the cylinder is connected to the base plate at 66; its piston rod 68 being connected to its respective bowl by a clevis pin 70, so that the cylinder moves the bowl between its deployed position, shown in FIG. 1, and a retracted position not obstructing the opening 26.

Figure 3:
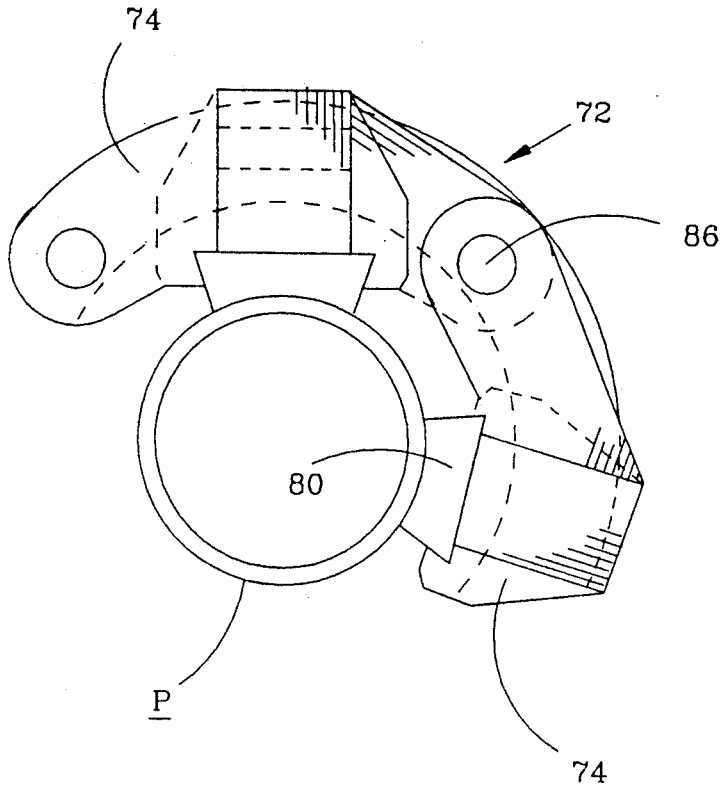
FIG. 3 is a top view of a portion of a slip assembly for use with the bowl assembly of FIG. 1, or the elevator of FIG. 7.
Figure 4:
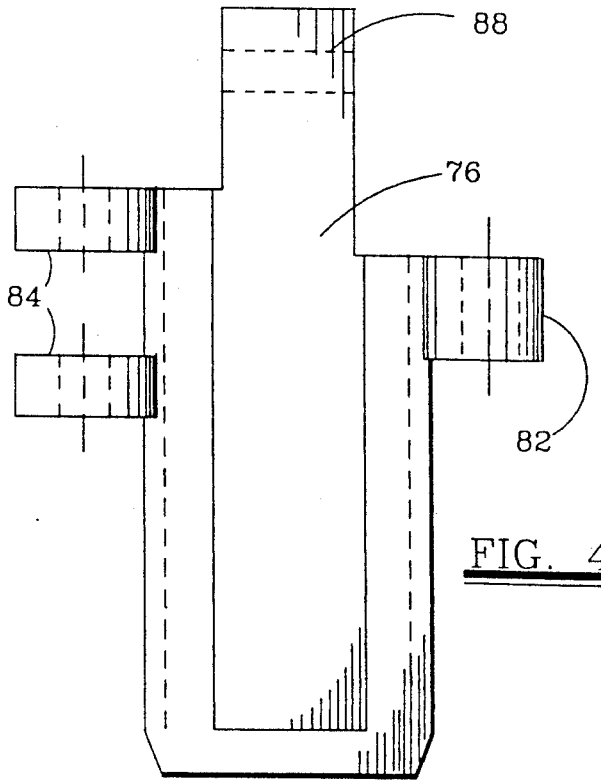
FIG. 4 is front view of one slip of the slip assembly.
Figure 5:
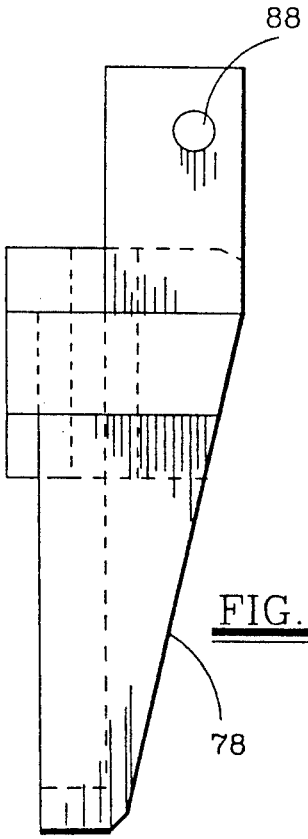
FIG. 5 is a side elevation thereof.
Figure 6:
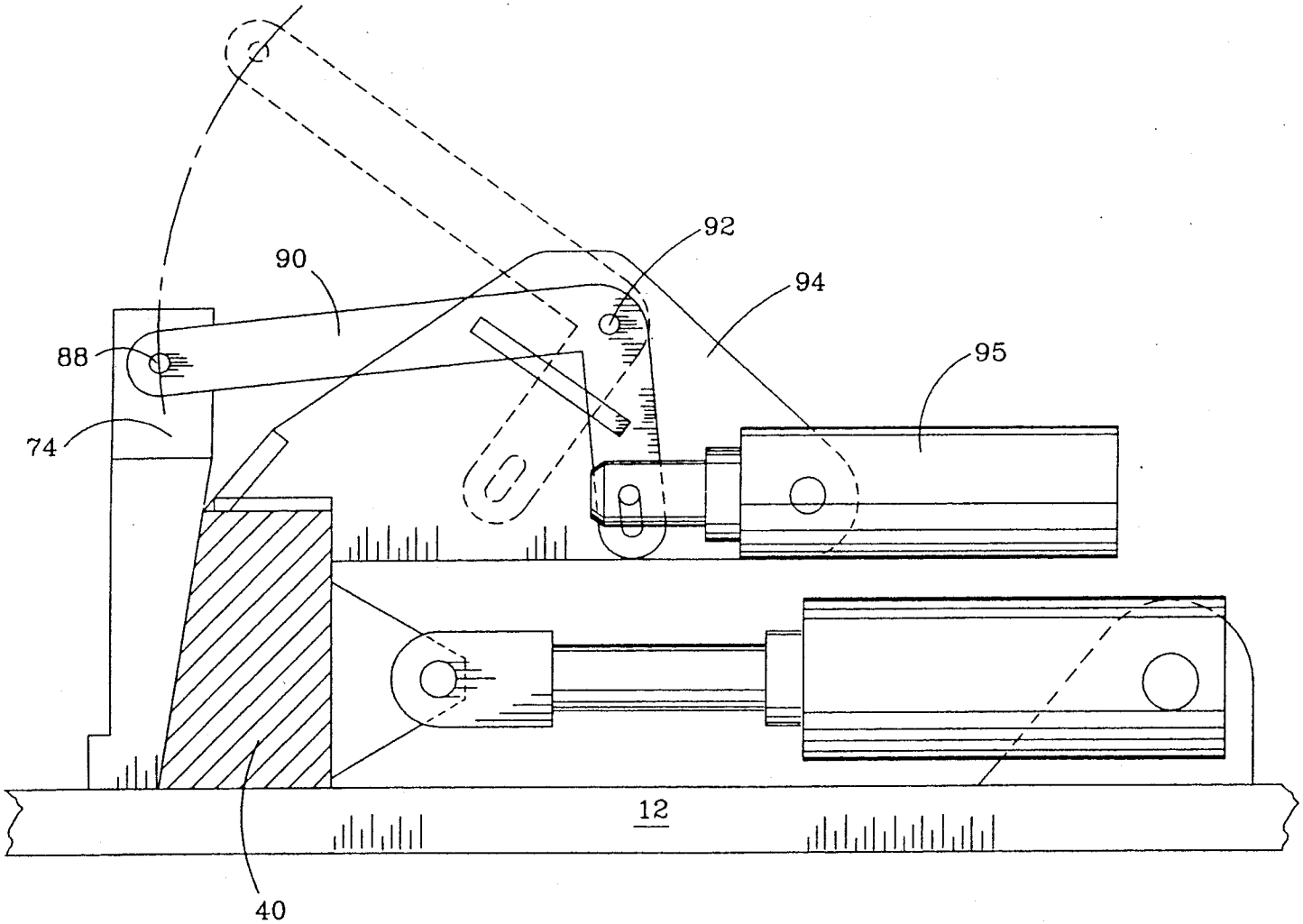
FIG. 6 is a side elevation of a pneumatic actuator for lifting the slip assembly with respect to its bowl.

As shown in FIG. 3 (looking down into the bowl), each bowl is provided with a slip assembly 72 for gripping the outer surface of the pipe P. The assembly comprises three flexibly interconnected slips 74, only two of which are shown in the FIG. 3, and one of which is shown in detail in FIGS. 4 and 5. Each slip has a body 76 with a radially outer surface 78 that is tapered at an angle corresponding to that of the bowls, so that the slips wedge against the pipe as they move downward. The surface of the slip facing the pipe is recessed to receive a toothed die 80 (FIG. 6). The lateral protrusions 82 and 84 seen in FIG. 4 are ears having holes through which a pin 86 (FIG. 3) is passed to provide a hinge joint with the neighboring slip. A hole 88 at the upper end of the body provides means for lifting the slip.

FIG. 6 shows a slip actuator, which was omitted from FIGS. 1 and 2 for clarity. One slip is shown in simplified form at 74; the hole 88 at its upper end is connected by a pin to one arm of an L-shaped lever 90 whose pivot point is a pin 92 affixed to a bracket 94. This bracket is attached to the bowl 40, as by welding, and thus moves with it as the bowl is retracted. Also affixed to the bracket 94 is a pneumatic cylinder 95, whose piston rod is connected by a pin-and-slot connection to the other end of the lever 90. Thus, extension of the rod lifts the slip.

An elevator 96 for lifting the pipes, or other tools, through the slip bowl assembly is shown in FIGS. 7 and 8, conventional details being omitted. The elevator includes a pair of lifting tabs 98, which are aligned substantially with the two large bowls, in accordance with a prior invention of applicant. The bowls 100 of the elevator are not retractable, since it is never necessary for a large tool to pass through the elevator (the tool can be removed below the elevator). Each of the bowls is provided with a slip assembly (not shown), which may be similar or identical to the slip assemblies described above.

Figure 9:
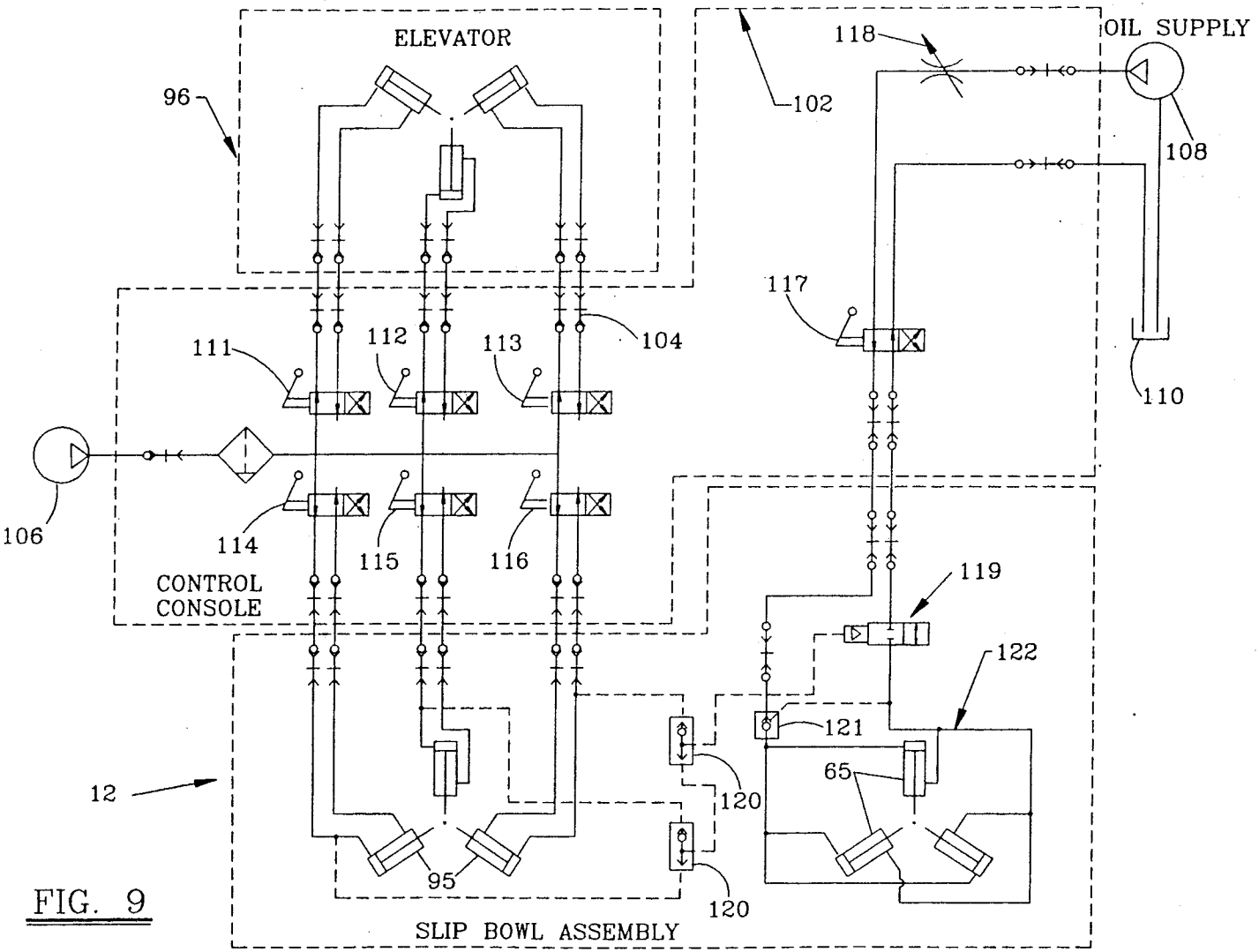
FIG. 9 is a schematic diagram showing hydraulic circuitry for the hydraulic components of the apparatus.

A control unit 102 for the hydraulic and pneumatic components of the invention is shown in the schematic of FIG. 9. Broken lines are used to delineate the major components (elevator 96, control unit 102, slip bowl assembly 12) wherein the various actuators are identified by reference numbers designated above. The components are connected by conventional hoses and conduits, the check valves 104 shown indicating the location of quick-disconnect couplings.

We prefer to use compressed air to operate the slip assemblies, and hydraulic fluid (oil) to operate the slip bowls. A source of compressed air is designated by reference numeral 106 at the left of the figure, while an oil pump 108 and reservoir 110 are shown at the right. (In the claims below, the term "fluid" is intended to be generic to both liquid and gases).

Flow of compressed air and hydraulic fluid is controlled manually be reversing valves 111–117, which connect one side of a given cylinder to pressurized fluid, and the other side to vent (i.e., the oil reservoir, or atmosphere, as the case may be). The variable choke 118 just downstream of the oil pump 108 enables one to vary the speed of the slip bowls as they are advanced or retracted.

Operation of the slips in the slip bowl assembly, and the movement of the slip bowls themselves, is interrelated by the circuitry shown in FIG. 9. The three slip actuator lines are connected via conduits—represented by dotted lines —to two double-acting check valves 120, which function as an "or" gate, so that pressurization of any one of these lines opens valve 119, allowing the bowls to be retracted. That is, valve 119 prevents retraction of the bowls while the slips are engaged. Item 121 is a pilot-operated check valve which locks the cylinders 65 in their extended positions until pressure is applied to the retracting line 122.

In operation, plural pipes are lowered into a well by the elevator, which is periodically raised, so that new sections of pipe can be added, while the pipes in the well casing are supported by the slip bowl assembly. Ordinarily, only the slips need to be actuated, and the bowls remain in their deployed position, partially obstructing the opening 26. When a large diameter tool or collar must enter the well, however, the pipes are secured by the elevator slips, and those of the bowl assembly are released, whereupon the valve 117 is thrown to retract the bowls away from the well centerline. Now the bowls provide no obstruction, and the tool can be lowered into the casing, whereafter the bowls are redeployed by returning valve 117 to its original position, and the slips are reengaged with the pipe strings by operating valves 114, 115 and 116.

Although the elevator and slip bowl assembly described above each have three slip bowls, it should be appreciated that the invention could be applied to any slip bowl unit, regardless of the number of bowls, and that suitable modification of the device would be within the skill of the artisan. Also, it would be within the skill of the artisan to substitute different types of actuators (e.g., electromagnetic motors) for the fluid-actuated devices presently preferred, for safety reasons. And it would likewise be possible to replace the manually operated valves shown in FIG. 9 with functionally equivalent other devices, including computer-controlled valving.

Inasmuch as the invention is subject to these and other modifications, it is intended that the foregoing should be interpreted only as illustrative of one form of the invention, and that the invention should be measured by the claims that follow.

I claim:

1. A slip bowl assembly for supporting a plurality of pipes, within a common well, from a drilling rig deck, comprising:

a base plate adapted to rest on said deck in a substantially horizontal position, said base plate having an opening for vertical passage therethrough of plural pipes, a plurality of slip bowls supported by said base plate each for receiving a respective one of the plurality of pipes, a plurality of slip assemblies each for positioning within a respective slip bowl, each slip assembly including a plurality of slips, a plurality of slip actuators each for vertically moving a slip assembly with respect to its respective slip bowl to cause the plurality of slips to grippingly engage and disengage from a respective one of the plurality of pipes, at least one motor for laterally moving at least one of the slip bowls and its respective slip assembly laterally between a deployed position over said opening to a retracted position away from said opening, to allow large drilling tools and the like to pass through the opening.

2. The invention of claim 1, wherein:

the at least one of the movable slip bowls has a lateral opening over its entire length of sufficient width to enable it to be withdrawn from its respective pipe, without removing the pipe from said opening, and at least one of the plurality of slips of the slip assembly for the at least one movable slip bowls is pivotably connected to another of the plurality of slips of the slip assembly.

3. The invention of claim 1, wherein:

said plurality of slip bowls include first, second and third slip bowls, and said base plate is formed in at least two separable sections, so that it can be removed from the drilling rig deck without removing said pipes from said opening, and further comprising:

a first plate section for supporting both the first slip bowl and the second slip bowl, a second plate section for supporting the third slip bowl, and removable means for holding said first and second plate sections together.

4. The invention of claim 1, further comprising:

a plurality of motors each for moving laterally a respective one of the plurality of slip bowls between its retracted and deployed positions.

5. The invention of claim 4, wherein each of said plurality of motors comprises a fluid-actuated piston confined within a cylinder.

6. The invention of claim 1, further comprising:

means for guiding said at least one movable slip bowl along a linear path in a direction parallel to said base plate, and substantially radial to said opening.

7. The invention of claim 1, wherein:

each of the plurality of slips of each slip assembly includes a tapered outer surface for seating within its respective slip bowl, each of said slips supporting a die for engaging the exterior surface of a pipe passing through said slip bowl.

8. The invention of claim 1, wherein:

each of said slip actuators is a fluid actuator secured to its respective slip bowl and comprising a cylinder, a linearly movable rod, and a linkage interconnecting the fluid actuator with a respective one of the slip assemblies.

9. The invention of claim 8, further comprising:

a bracket affixed to a respective one of said slip bowls, one of said fluid actuators being affixed to said bracket in a horizontal position, and said linkage of the respective slip actuator includes an L-shaped arm pivoted at its apex to said bracket, the ends of said arm being connected to said fluid actuator and said slip assembly, respectively.

10. A slip bowl assembly for supporting a plurality of pipes, within a common well, from a drilling rig deck, comprising a base plate adapted to rest on said deck in a substantially horizontal position, said base plate having an opening for vertical passage therethrough of at least one pipe, a slip bowl supported by said base plate, said slip bowl being laterally movable between a deployed position over said opening to a retracted position away from said opening, to allow large drilling tools and the like to pass through the opening, a first fluid motor for moving said bowl between its retracted and deployed positions, a slip assembly associated with said bowl for supporting said pipe therein, a second fluid motor for moving said slip assembly between a position engaged with said pipe and a position in which said pipe is released, a source of pressurized fluid, and means for controlling flow of said fluid to said first and second motors, said flow controlling means preventing retraction of said bowl by said first motor except when said slip assembly is in its released position.

11. A slip bowl assembly as defined in claim 10, further comprising:

a plurality of slip bowls supported by the base plate, each slip bowl for receiving a respective one of the plurality of pipes, a plurality of slip assemblies each associated with a respective one of the slip bowls for supporting said pipe therein, a plurality of second fluid motors each for moving a respective slip assembly between the engaged position and the released position, and a plurality of first fluid motors each for laterally moving a respective slip bowl and its associated slip assembly between the deployed position and the retracted position.

12. A slip bowl assembly as defined in claim 10, wherein:

the slip bowl has a lateral opening over its length to enable the slip bowl to be withdrawn from its respective pipe without removing the pipe from the opening in the base plate, and the slip assembly includes a plurality of slips, at least one of the slips being pivotably connected to another of the slips such that the slip assembly can effectively grip the pipe when in the engaged position while allowing the pipe to move laterally through the slip assembly during actuation of the first fluid motor.

13. A slip bowl assembly as defined in claim 10, further comprising:

guide means for guiding the slip bowl along a linear path in a direction parallel to said base plate and substantially radial to said opening.

14. A slip bowl assembly for supporting a plurality of pipes within a common well, comprising:

a plate having an opening for vertical passage of the plurality of pipes, a plurality of slip bowls each supported by the plate and adapted for receiving a respective one of the plurality of pipes, each of the slip bowls having a bore defined at least in part by a conical tapered wall, a plurality of slip assemblies each for cooperation with a respective slip bowl to support the respective pipe, each slip assembly including a plurality of slips, each slip having a tapered outer surface for seating with a respective conical tapered wall, and an interior surface for grippingly engaging the respective pipe, a plurality of slip actuators each for vertically moving a slip assembly with respect to its respective slip bowl to cause the plurality of slips to grippingly engage and disengage from the respective one of the plurality of pipes, and at least one motor for laterally moving at least one of the slip bowls and its respective slip assembly laterally between a deployed position over said opening to a retracted position away from said opening to allow drilling tools to pass through the opening.

15. A slip bowl assembly as defined in claim 14, further comprising:

an elevator body fixed to the plate, the plurality of slip bowls includes a first slip bowl and a second slip bowl each fixed with respect to the elevator body, and a third slip bowl laterally movable with respect to the elevator body, and the at least one motor laterally moves the third slip bowl and its respective slip assembly laterally with respect to the elevator body and the first and second slip bowls.

16. A slip bowl assembly as defined in claim 15, further comprising:

each of the plurality of slip actuators is secured to its respective slip bowl, such that the at least one motor laterally moves the at least one slip bowl and the slip actuator secured thereto.

17. A slip bowl assembly as defined in claim 14, further comprising:

a source of pressurized fluid for powering each of the plurality of slip actuators and the motor, and valve means for controlling flow of the pressurized fluid to said motor, said valve means preventing retraction of said at least one of the slip bowls by said motor except when each of the slip assemblies are in its released position.

18. A slip bowl assembly as defined in claim 17, further comprising:

a variable choke downstream from the source of pressurized fluid for varying the speed which the at least one slip bowls are advanced and retracted.

19. A slip bowl assembly as defined in claim 14, further comprising:

the at least one laterally movable slip bowl having a lateral opening in its wall to enable the respective pipe to pass therethrough, and at least one of the plurality of slips of the slip assembly for the at least one movable slip bowl being pivotably connected to another of the plurality of slips of the slip assembly such that the slip assembly can effectively grip the pipe when in the engaged position while allowing the pipe to move laterally through the slip assembly during actuation of the motor.

20. A slip bowl assembly as defined in claim 14, further comprising:

guide means for guiding the at least one movable slip bowl along a linear path in a direction parallel to the plate and substantially radial to the opening in the plate.

* * * * *